US005670290A

United States Patent [19]

Manzolati

[11] Patent Number: 5,670,290

[45] Date of Patent: Sep. 23, 1997

[54] RECLAIMING DRUMS

[75] Inventor: Richard J. Manzolati, Rochester, N.Y.

[73] Assignee: Xerox Corporation, Stamford, Conn.

[21] Appl. No.: 610,095

[22] Filed: Feb. 29, 1996

[51] Int. Cl.[6] ..... G03G 5/10; C23F 1/00

[52] U.S. Cl. ..... 430/125; 216/65

[58] Field of Search ..... 430/69, 125; 156/664; 134/6, 41; 216/65

[56] References Cited

U.S. PATENT DOCUMENTS 4,076,564 2/1978 Fisher ..... 430/69

4,617,245 10/1986 Tanaka et al. ..... 430/69

5,562,840 10/1996 Swain et al. ..... 216/65

*Primary Examiner*—John Goodrow

[57] ABSTRACT

A reclaiming process including providing a drum including a hollow cylindrical substrate coated with at least one electrophotographic imaging layer, the substrate having an outer surface describing a curvilinear plane, removing the imaging layer, and removing material from the substrate to a radial distance between about 10 micrometers and about 400 micrometers from the curvilinear plane to form a reclaimed substrate having a total indicated run out variation mean of less than about 160 micrometers and which is free of distortions visible to the naked eye.

22 Claims, No Drawings

RECLAIMING DRUMS

BACKGROUND OF THE INVENTION

This invention relates in general to cylindrical drums and more specifically, to a process for reclaiming cylidnrical drums and for using the reclaimed drums for electrophotographic imaging.

In the art of electrophotography an electrophotographic imaging member comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electrostatically attractable toner particles on the surface of the photoconductive insulating layer. The resulting visible toner image can be transferred to a suitable receiving member such as paper. This imaging process may be repeated many times with reusable photoconductive insulating layers.

Electrophotographic imaging members having a drum configuration are usually multilayered photoreceptors that comprise a rigid hollow rigid cylindrical substrate having a conductive layer, an optional hole blocking layer, a charge generating layer, and a charge transport layer. These layers are usually formed by a coating process such as dip coating or spraying. Excellent toner images may be obtained with these multilayered drum photoreceptors. Generally, after use in a copier, printer or duplicator, the drum photoreceptor cannot be readily reclaimed by merely removing the coatings and applying fresh coatings. For example, during image cycling in a copier, printer or duplicator, the outer surface at the ends of the drums tend to contain grooves which were formed by contact with various devices such as seals and developer roll spacing means during image cycling. If the old coatings on the drum substrates are removed and the drum merely recoated with fresh coatings and reinstalled into a copier, printer or duplicator for further imaging, the grooves lead to degradation of imaging because the grooves continue to deepen and bring subsystems such as charging and developing applicator rolls too close to the imaging surface of the photoreceptor.

In addition to undesirable changes in drum to charger or applicator roll spacings, the image quality characteristics of drums that are merely recoated with the fresh photoconductive coating can be very poor because of scratches present in the drum substrate surface that were formed prior to recoating. These scratches often occur during previous use, during handling when the drum was returned for recycling, during handling of new unused drums, or during handling of uncoated drums.

Further, if coatings are removed from a drum substrate by processes such a solvent removal, the handling and disposal of the solvent presents difficulties from the environmental impact point of view. Also, solvent removal processes require elaborate and expensive equipment and are also time intensive. Other coating removal systems involving blasting a coated drum with beads is slow and is less effective than solvent cleaning to remove all of the old coating from a substrate. Thus, these solvent removal and bead cleaning techniques fail to provide satisfactory reclaimed photoreceptors wherein the imaging surfaces of the drum are worn or where scratches exist in the drum surface in the imaging areas of used drums or newly coated electrophotographic drums. Generally, many of these scratched or worn used drums are sold as scrap.

Thus, techniques for the recycling of electrophotographic imaging members exhibit deficiencies which fail to satisfy the many high tolerance requirements of sophisticated automatic, cycling imaging systems.

SUMMARY OF THE INVENTION

It is an object of this invention to provide a process for reclaiming and resusing an electrophotographic imaging member or electrophotographic imaging member substrate which overcomes the above-noted disadvantage.

It is another object of this invention to provide a recycled electrophotographic imaging member that provides excellent spacing between the imaging surface and electrophotographic imaging subsystems such as developer applicator rollers, charging devices, transfer devices and the like.

It is yet another object of this invention to provide a reclaiming process which recycles worn electrophotographic drums.

It is still another object of this invention to provide a reclaiming process which recycles damaged newly coated drums.

It is yet another objection of this invention to provide a reclaiming which is more economical.

The foregoing objects and others are accomplished in accordance with this invention by providing a reclaiming process including providing a drum including a hollow cylindrical substrate coated with at least one electrophotographic imaging layer, the substrate having an outer surface describing a curvilinear plane, removing the imaging layer, and removing material from the substrate to a radial distance between about 10 micrometers and about 400 micrometers from the curvilinear plane to form a reclaimed substrate having a total indicated run out variation mean of less than about 160 micrometers and which is free of distortions visible to the naked eye. The expression "distortions" as employed herein is defined to include, for example, scratches, nicks, grooves, and wavey/distorted surface defects visible to the naked eye. This substrate may be coated with at least one electrophotographic imaging layer and also may be cycled in an electrophotographic imaging system.

Electrostatographic imaging members (i.e.photoreceptors) are well known in the art. The electrostatographic imaging members may be prepared by various suitable techniques. Typically, a substrate is provided having an electrically conductive surface. At least one photoconductive layer is then applied to the electrically conductive surface. An optional thin charge blocking layer may be applied to the electrically conductive layer prior to the application of the photoconductive layer. For multilayered photoreceptors, a charge generation layer is usually applied onto the blocking layer and charge transport layer is formed on the charge generation layer. For single layer photoreceptors, the photoconductive layer is a photoconductive insulating layer and no separate, distinct charge transport layer is employed. For the sake of simplification, the various coatings applied to the substrate to form an electrophotographic imaging member will be referred to collectively herein as "at least one electrophotographic imaging layer". Similarly, the expression "drum" is intended to include coated cylindrical photoreceptors and uncoated cylindrical photoreceptor substrates.

Any suitable size drum may be reclaimed with the process of this invention. Typical drum diameters include, for example, diameters of about 30 millimeters, 40 millimeters, 85 millimeters, and the like. preferably, the surface of the drum being coated is smooth. However, if desired, the drum may be slightly roughened by honing, sand blasting, grit blasting, rough lathing, and the like. Such slight roughening forms a surface which varies from the average diameter by less than about plus or minus 8 micrometers. The surface of the drum being coated is preferably inert to the components in the liquid coating materials applied. The drum surface may be a bare, uncoated surface or may comprise the outer surface of a previously deposited coating or coatings. The previously deposited coatings may be fresh and unused or old and used. However, the surface of the drum normally contains a defect such as a scratch, groove, abrasions inclusions, nicks, pits, and the like. The substrate may be opaque or transparent and may comprise numerous suitable materials having the required mechanical properties. Accordingly, the substrate may comprise a layer of an electrically non-conductive or conductive material such as an inorganic or an organic composition. As electrically non-conducting materials there may be employed various thermoplastic and thermosetting resins known for this purpose including, for example, polyesters, polycarbonates, polyamides, polyurethanes, and the like. Typical metal substrates include, for example, aluminum, stainless steel, nickel, brass, and the like. The electrically insulating or conductive substrate should be rigid and in the form of a hollow cylindrical drum. Preferably, the substrate comprises a metal such as aluminum.

The thickness of the substrate layer depends on numerous factors, including resistance to bending and economical considerations, and thus this layer for a drum may be of substantial thickness, for example, about 30 micrometers, or of minimum thickness such as about 15 micrometers. Thicknesses outside this range may be employed, provided there are no adverse effects on the final electrostatographic device.

The conductive layer may vary in thickness over substantially wide ranges depending on the optical transparency desired for the electrostatographic member. Accordingly, the conductive layer and the substrate may be one and the same or the conductive layer may comprise a coating on the substrate. Where the conductive layer is a coating on the substrate, the thickness of the conductive layer may be as thin as about 30 angstroms, and more preferably at least about 100 Angstrom units for optimum electrical conductivity. The conductive layer may be an electrically conductive metal layer formed, for example, on the substrate by any suitable coating technique, such as a vacuum depositing technique or tribo adhesion. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like.

Regardless of whether a conductive metal layer is the substrate itself or a coating on the substrate, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. The conductive layer need not be limited to metals. Other examples of conductive layers may be combinations of materials such as conductive Indium tin oxide or carbon black loaded polymer. A typical surface resistivity for conductive layers for electrophotographic imaging members in slow speed copiers is about 102 to 103 ohms/square.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Typical blocking layers include, for example, polyamides, polyvinylbutyrals, polysiloxanes, polyesters, nylons (e.g. Luckimide), zirconium/silicon, and the like and mixtures thereof. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_4]CH_3Si(OCH_3)_2$ (gamma-aminopropyl) methyl diethoxysilane, as disclosed in U.S. Pat. No. 4,338,387, U.S. Pat. No. 4,286,033 and U.S. Pat. No. 4,291,110. The disclosures of U.S. Pat. No. 4,338,387, U.S. Pat. No. 4,283,033 and U.S. Pat. No. 4,291,110 are incorporated herein in their entirety. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage. Drying of the deposited coating may be effected by any suitable conventional technique such as oven drying, infra red radiation drying, air drying and the like.

Any suitable photogenerating layer may be applied to the blocking layer. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light. Generally, the average particle size of the pigment dispersed in the charge generating layer is less than about 1 micrometer. A preferred average size for pigment particles is between about 0.05 micrometer and about 0.2 micrometer.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include resins such as polyvinylbutyral, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, and the like and mixtures thereof. These polymers may be block, random or alternating copolymers.

Any suitable solvent may be employed to dissolve the film forming binder. Typical solvents include, for example, n-butyl acetate, methylene chloride, tetrahydrofuran, and the like.

Satisfactory results may be achieve with a pigment to binder weight ratio of between about 40:60 and about 95:5. Preferably, the pigment to binder ratio is between about 50:50 and about 90:10. Optimum results may be achieved with a pigment to binder ratio of between about 60:40 and about 80:20 ratio.

Various factors affect the thickness of the deposited charge generating layer coating. These factors include, for example, the solids loading of the total liquid coating material, the viscosity of the liquid coating material, and the relative velocity of the liquid coating material in the space between the drum surface and coating vessel wall. Satisfactory results are achieved with a solids loading of between about 2 percent and about 12 percent based on the total weight of the liquid coating material; the "total weight of the solids" being the combined weight of the film forming binder and pigment particles and the "total weight of the liquid coating material" being the combined weight of the film forming binder, the solvent for the binder and pigment particles. Preferably, the liquid coating mixture has a solids loading of between about 3 percent and about 11 percent by weight based on the total weight of the liquid coating material. The thickness of the deposited coating varies with the specific solvent, film forming polymer and pigment materials utilized for any given coating composition. For thin coatings, a relatively slow drum withdrawal (pull) rate is desirable when utilizing high viscosity liquid coating materials. Generally, the viscosity of the liquid coating material varies with the solids content of the liquid coating material. Satisfactory results may be achieved with viscosities between about 1 centipoise and about 100 centipoises. Preferably, the viscosity is between about 2 centipoises and about 10 centipoises.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

Any suitable and conventional technique may be utilized to mix and thereafter apply the photogenerating layer coating mixture. Typical application techniques include spraying, dip coating,—tribo, and the like. Any suitable and conventional technique may be utilized to dry the deposited coating. Typical conventional techniques include, for example, oven drying, infra red radiation drying, air drying and the like. After drying, the deposited charge generating layer thickness generally ranges in thickness of from about 0.1 micrometer to about 5 micrometers, and preferably between about 0.05 micrometer and about 2 micrometers. The desired photogenerating layer thickness is related to binder content. Higher binder content compositions generally require thicker layers for photogeneration. Thicknesses outside these ranges can be selected providing the objectives of the present invention are achieved.

The active charge transport layer may comprise an activating compound useful as an additive dispersed in electrically inactive polymeric materials render these materials electrically active. These activating compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. A typical transport layer employed in one of the two electrically operative layers in multilayered photoconductors comprises from about 25 percent to about 75 percent by weight of at least one charge transporting aromatic amine compound, and about 75 percent to about 25 percent by weight of a polymeric film forming resin in which the aromatic amine is soluble. The charge transport layer forming mixture may, for example, comprise an aromatic amine compound of one or more compounds having the general formula:

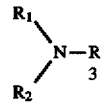

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as NO2 groups, CN groups, and the like. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the charge transport layer. Typical inactive resin binders soluble in methylene chloride include polycarbonate resin, polyvinylcarbazole, polyester, polyarylate, polyacrylate, polyether, polysulfone, and the like. Molecular weights can vary, for example, from about 20,000 to about 150,000.

Any suitable and conventional technique may be utilized to mix the charge transport layer coating mixture. A preferred coating technique utilizes dip coating. Various factors affect the thickness of the dip deposited charge transport layer coating. These factors include, for example, the solids loading of the total liquid coating material, the viscosity of the liquid coating material, and the relative velocity of the liquid coating material in the space between the drum surface and coating vessel wall. Satisfactory results are achieved with a solids loading of between about 40 percent and about 65 percent based on the total weight of the liquid coating material; the "total weight of the solids" being the combined weight of the film forming binder and the activating compound and the "total weight of the liquid coating material" being the combined weight of the film forming binder, the activating compound and the solvent for the binder and and activating compound. The thickness of the deposited coating varies with the specific solvent, film forming polymer and activating compound utilized for any given coating composition. For thin coatings, a relatively slow drum withdrawal (pull) rate is desirable when utilizing high viscosity liquid coating materials. Generally, the viscosity of the liquid coating material varies with the solids content of the liquid coating material. Satisfactory results may be achieved with viscosities between about 100 centipoise and about 1000 centipoises. Drying of the deposited coating may be effected by any suitable conventional technique such as oven drying, infra red radiation drying, air drying and the like.

Generally, the thickness of the hole transport layer is between about 10 to about 50 micrometers after drying, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

Optionally, an overcoat layer may also be utilized to improve resistance to abrasion. Overcoatings are continuous and generally have a thickness of less than about 10 micrometers.

The smallest surface imperfection or defect in the surface of a drum substrate will lead to rejection of the drum for precision electrophotographic imaging. It has been found that lathing of a scratched or worn coated drum with a gear driven lathe produces drums which, when coated with fresh electrophotographic imaging layer material, form poor quality electrophotographic images that vary in density. Although an average diameter of a drum lathed on a gear driven lathe may visually appear acceptable, it was determined that such a drum was unsuitable for precision electrophotographic imaging systems. When such a drum is rotated about its axis, the radius of the drum relative to a fixed center line along the axis of the drum varies considerably as rotationally measured around and along the length of the axis from one end to the other.

Lathing of hollow metal cylinders is well known and involves mounting the cylinder between a headstock spindle and a tailstock spindle of a lathe. The headstock spindle is rotated by a high precision—electric motor free of vibrations.—While the cylinder is being rotated, an edge of a cutting tool is brought into contact with one end of the rotating drum to remove material from the drum. A rough cutting tool is usually employed for inital cutting and a finish cutting tool is usually employed for final cutting. The edge of a cutting tool is moved from one end of the drum to the other as the drum is being rotated to remove material from the drum periphery along length the drum. The rough cut tool and the finish cut tool are mounted as a set on a lath traverse. The finish cut tool is normally incremented in relationship to the rough cut tool (e.g. if the rough cut tool is moved towards the drum a distance of about 15 micrometers the finish cut tool also moves inwardly the same distance). The diamond or finish cut tool is normally indexed off the rough cut tool. The diamond or finish cut tool is usually about 10 micrometers to 25 micrometers closer to the substrate and removes more material. Both cuts can occur at the same time with the finish cut traveling just behind the rough cut. Alternatively the rough cut tool can cut, for example, right to left before the finish cut tool is indexed in the 10 micrometers to 25 micrometers to cut on the left to right return. The precision relationship of these two tools is important for multiple reclaiming of the same drum time after time.

It has been found that total indicated run out (TIR) of drums, not the average diameter (i.e., below specification), is an important characteristic for drums utilized in sophisticated high tolerance copiers, duplicators and copiers. The expression "total indicated run out", as employed herein, is defined as The measurement of the deviation of the surface of the outside diameter of a drum with respect to the centerline of the drum. Measurement may, for example be effected by mounting a drum on centers, rotating the drum and traversing the length of the drum with a dial indicator mounted to a fixture that is parallel to the centerline of the drum. The total indicated dial movement reading is the TIR.

For example, the focal length of a lens exposure system to the radius of the drum during enlargements of an original is a critical factor on some precision imaging machines. Lathing of the substrate removes surface contaminations and handling abrasions and scratches. Surprisingly, a reduced diameter drum fabricated with the process of this invention forms satisfactorily electrophotographic images after coating, even in conventional imaging systems utilizing optical systems which enlarge images. It has been found that when a drum substrate is made smaller in diameter and a scanning light is reflected from the image on an original document, the focal length between the scanning mirror and drum surface can cause blurring if the drum diameter is less than about 2.5 percent of the original diameter. However, this blurring problem when drum diameter is less than about 2 to 3 percent of the original diameter may be avoided by utilizing the drum in a digital imaging system which does not utilize a focal length optic imaging system.

Satisfactory imaging results are achieved with a lathed drum having TIR variation from mean of up to about 160 micrometers. The expression "mean", as employed herein, is defined as the situation where the outside diameter of the substrate does not deviate at all from it center line (i.e. the substrate is a perfect cylinder and it is mounted on its center line. Preferably, the variation in TIR from mean is less than about 80 micrometers. Optimum imaging results are achieved with a TIR variation of less than about 50 micrometers.

In order to minimize TIR variation, vibration within the lathing system must be minimized during the lathing operation. It has been discovered that the total indicated run out (TIR) of drums lathed on ordinary gear driven lathes causes variation in the density of the final toner images, particularly in toner images covering large solid areas. Thus, the variation occurring in drums lathed with ordinary gear driven lathes is unacceptable for precision electrophotgraphic copies, duplicators and printers. However, a high precision gear driven lathe using headstock and tailstock spindles supported in air or magnetic bearings coupled with a a precision lead screw and carriage can avoid undesirable vibrations and achieve the proper TIR and surface finish free of scratches visible to the naked eye. A belt or hydraulic drive system with spindles supported in high precision sleeve bearings may provide an acceptable surface finish, but the process latitudes will suffer.

Surprisingly, drums lathed on a lathe driven by a belt or hydraulic drive system can provide reclaimed drums suitable for precision electrophotgraphic copies, duplicators and printers. Typical lathes driven by a belt or hydraulically are commercially available. It has been found that these lathe drive systems comprising a belt or hydraulic drive system can provide a TIR variation of less than about 160 micrometers with greatly reduced vibrations. This is particularly important for the thin walled reduced mass OPC drums which are highly prone to defect causing vibrational harmonics and by the reclaiming of walls which are cut even thinner. Belt driven lathes comprise an electric motor which is connected to the lathe by belts which provide the motivating force to the lathe. The connection by drive belts allows the vibrations of the operating motor to be isolated by avoiding direct attachment to the lath. Additional vibrational isolation is accomplished by shock and damping mounting on the motor and lathe on separate bases. If the building foundation vibrates, the floor can be cut away and isolation bases can be poured for the lathe and for the motor. Hydraulically driven lathes comprise a separate electric motor attached to a hydraulic pump connected to the lathe by flexible hoses with hydraulic dampeners in the line. This powers hydraulic motors attached to the lathe. This connection by hoses allows the vibrations of the operating motor to be isolated by avoiding direct attachment to the lathe. Additional vibrational isolation is accomplished by shock and damping means including mounting the motor and lathe on the separate bases. If the building foundation vibrates, the floor can be cut away and isolation bases can be poured for the lathe and for the motor.

Exceptionally low TIR variations are achieved with lathes utilizing headstock and tailstock spindles supported in air bearings. Typical lathes utilizing headstock and tailstock spindles supported in air bearings and driven by non-geared precision electric motors, a belt or hydraulic system are commercially available from, for example, Brian Simmons. Air bearings comprise a porous sleeve such as a sleeve formed from sintered metal particles through which compressed air flows. This flowing compressed air supports the rotating headstock and tailstock spindles. Air bearings are also commercially available. Generally, satisfactory results are achieved with a spindle rotational speed between about 4000 revolutions per minute and about 5500 revolutions per minute. However, rotational speeds outside of this range may be utilized so long as the objectives of this invention are met. Thus, for example, larger diameter drums may be lathed at a lower rpm than small diameter drums.

Preferably initial lathing of a drum to be reclaimed is conducted with a carbide bit set at a nominal cutting depth of between about 15 micrometers and about 18 micrometers. The expression "nominal cutting depth" as employed herein is defined as just sufficient depth to remove all the coatings (e.g. about 15–22 micrometers). The carbide bit may have any suitable shaped tip. Cutting depths greater than about 18 micrometers can cause undesirable overheating of the drum or gouging of the drum surface. Cuts smaller than about 15 micrometers can be made to initially clean the exterior surface of the drum, but this will decrease processing throughput and can also increase the likelihood of causing TIR variations. The initial removal of material from the drum removes the electrophotographic imaging layer which comprises a single or multiple layers. The initial substrate material removal depth is measured from the original outer surface of the substrate which describes a curvilinear plane in a radial direction toward the axis or centerline of the substrate. After initial removal of material from the outer drum surface, additional material is removed utilizing a suitable bit such as a diamond bit. The diamond bit may have any suitable shaped tip. The diamond bit removes material from the drum, measured from the original outer surface of the substrate which describes a curvilinear plane in a radial direction toward the axis of the drum, to a depth of between about 10 micrometers and about 25 micrometers. If any scratches are still observed after lathing, additional material may be incrementally removed to a depth as much as 400 micrometers measured from the original outer surface of the drum in a radial direction toward the axis of the drum. Thus, any suitable incremental amount up to the 400 micrometers may be removed to eliminate any remaining visible scratch after initial lathing. The 400 micrometer value may be greater and depends in the particular imaging, scanning or charging systems employed. Excessive vibrational defects on the machined substrate or loss of resolution on the print due to poor electrical transfers or poor image focusing during extremes in reduction and enlargements of light lens machines will affect the maximum amount of material that can be removed from the substrate. Also, the original thickness of the substrate must also be taken into account.

Lathing should not remove so much material from the substrate that the substrate is weakened and rendered unusable because of excessive flexing.

To achieve minimum TIR variation, it is important that during lathing, with either the carbide bit or the diamond, material removal is continuous and uninterrupted from one end of the drum to the other.

Prior to drum lathing, the inner exposed surface of the drum substrate should be cleaned to remove all particulate material present including, for example, any glue particles that were used to secure supporting endcaps to the opposite ends of the drum. Removal of all foreign material from the interior of the hollow cylindrical drum interior facilitates true drum rotation during lathing and minimizes variations in TIR. Removal of foreign material from the interior of the hollow cylindrical drum interior may be achieved by any suitable method. Typical cleaning includes, for example blasting with beads, solvent wash, brushes, scrapers, close tolerence punches, and the like and combinations thereof.

Alternatively, a superfinisher grinder may be substituted for a precision lathe to reclaim a drum by removing the coating and refinishing the underlying substrate surface or merely for refinishing the substrate surface after the coating has been removed. A superfinisher grinder comprises a plurality of nonwoven cloth belts, each of which are impregnated with different grinding media (e.g. three different belts, one with medium, another with fine and and the third with superfine grinding media). The drums in a horizontal line are conveyed by progressing rollers that rotate and move the drums past and against these belts. The size of each of the grinding media for the belts is selected to produce the desired final surface finish on the drum (eg. a rougher matt surface for laser printers).

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A used photoreceptor drum was provided which comprised a hollow cylindrical aluminum substrate coated with a nylon charge blocking layer, a charge generating layer comprising finely divided organic photoconductive pigment particles dispersed in a polyvinyl butyral film forming binder, and a charge transport layer comprising an arylamine charge transporting small molecule dissolved in a polycarbonate film forming binder. The aluminum substrate had a thickness of 40000 micrometers, a diameter of 84 millimeters, and a length of 310 centimeters. The charge blocking layer had a thickness of 0.7 micrometer. The thickness of the charge generating layer was 0.9 micrometer. The charge transport layer was 20 micrometers thick. The interior of this hollow photoreceptor drum was washed with methylene chloride to remove any contamination present. This photoreceptor was then mounted in a lathe between a headstock spindle and a tailstock spindle. The lathe was a motor driven lathe (available from Brian Simmons) in which a precision motor directly drove the headstock spindle. The spindles were rotatably supported in, precision sleeve bearings. The drum was rotated at a speed of 4800 revolutions per minute. This drum was then cut with a carbide bit set at a "nominal" dimension which produced a substrate which had a radius of 41.9515 millimeters. This drum was thereafter cut with a diamond bit set at a "nominal" dimension which produced a substrate which had a radius of 41.9515 millimeters. The resulting drum had an average radius of 41.9515. However, the TIR of this drum was 59 micrometers. TIR was determined by laser measurement in which the drum is mounted on a lath with the inside diameter on centers. The drum is rotated and the laser mounted on the carriage traverses the drum. This arrangement measures the distance variation between the outside diameter of the drum and a straight edge. The maximum variation of the outside radius of the drum from its centerline (the straight edge is referenced to the centerline) being the TIR (expressed in terms of diameter or radius). This lathed drum was then dip coated with fresh coatings having compositions identical to the original coatings. After drying, the fresh charge blocking layer had a thickness of 0.7 micrometer, the charge generating layer had a thickness of 0.9 micrometer, and the charge transport layer had a thickness of 20 micrometers. This freshly coated photoreceptor was tested in a Xerox 5012 xerographic printer. Examination of the print images revealed that there were no problems with operation in the printer and the print quality was excellent.

EXAMPLE II

The procedures described in Example I were repeated with another substantially identical used photoreceptor, except that a gear driven lathe (available from Gisholt) was substituted for the motor driven lathe. The resulting drum had an average radius of 1.928 millimeters. However, the TIR of this drum was 128 micrometers. Moreover, the outer surface of the resulting drum bore chatter/barberpole vibrational marks. This lathed drum was then dip coated with fresh coatings having compositions identical to the original coatings on the drum. After drying, the fresh charge blocking layer had a thickness of 1 micrometer, the charge generating layer had a thickness of 0.3 micrometer, and the charge transport layer had a thickness of 19 micrometers. This freshly coated photoreceptor was tested in a Xerox 5012 xerographic printer. Examination of the print images revealed that chatter/barberpole vibrational marks were readily visible in the solid areas of halftone images.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A reclaiming process comprising providing a drum comprising a hollow cylindrical substrate coated with at least one electrophotographic imaging layer, said substrate having an outer surface describing a curvilinear plane, removing said imaging layer, and removing material by precision lathing or by superfinishing grinding from said substrate to a radial distance between about 10 micrometers and about 400 micrometers from said curvilinear plane to form a reclaimed substrate having a total indicated run out variation mean of less than about 160 micrometers and which is free of distortions visible to the naked eye.

2. A reclaiming process according to claim 1 wherein said substrate contains a groove prior to said removal of said material from said substrate and said removal of said material eliminates said groove.

3. A reclaiming process according to claim 1 wherein said imaging layer has a thickness between about 15 micrometers and about 60 micrometers.

4. A reclaiming process according to claim 1 wherein material is removed from said substrate to a radial distance between about 10 micrometers and about 40 micrometers from said curvilinear plane.

5. A reclaiming process according to claim 1 wherein said material is metal.

6. A reclaiming process according to claim 1 wherein said substrate has a total indicated run out variation mean of less than about 80 micrometers.

7. A reclaiming process according to claim 1 wherein said substrate has a total indicated run out variation mean of less than about 50 micrometers.

8. A reclaiming process according to claim 1 including removing said layer and said material from said drum while said drum is supported in a lathe by a headstock spindle at one end of said drum and a tailstock spindle at an opposite end of said drum, said headstock spindle and said tailstock spindle being supported by bearings selected from the group consisting of magnetic bearings, hydrostatic bearings and air bearings.

9. A reclaiming process according to claim 1 including removing said layer and said material from said drum with a hydraulically driven lathe.

10. A reclaiming process according to claim 1 including removing said layer and said material from said drum with an air driven lathe.

11. A reclaiming process according to claim 1 including removing said layer and said material from said drum with a belt driven lathe.

12. A reclaiming process according to claim 1 including initially removing said layer and said material from said substrate to a nominal cutting depth of between about 10 micrometers and about 30 micrometers from said curvilinear plane with a carbide bit.

13. A reclaiming process according to claim 12 including initially removing said layer and said material from said drum with said carbide bit continuously from one end of said drum to an opposite end of said drum.

14. A reclaiming process according to claim 12 including, after initially removing said layer and said material from said drum with said carbide bit, and removing additional material to an additional nominal cutting depth of between about 10 micrometers and about 25 micrometers with a diamond bit.

15. A reclaiming process according to claim 14 including removing said additional material with said diamond bit continuously from one end of said drum to an opposite end of said drum.

16. A reclaiming process according to claim 14 including removal of said materials by simultaneously traversing said drum with both said carbide bit and said diamond bit in tandom continuously from one end of said drum to an opposite end of said drum.

17. A reclaiming process according to claim 14 including incrementally removing additional material from said drum to a depth greater than about 25 micrometers and less than about 400 micrometers until said drum is free of all scratches visible to the naked eye.

18. A reclaiming process according to claim 1 wherein said drum has an interior surface.

19. A reclaiming process according to claim 18 including cleaning said interior surface to removal all particulates prior to removing any of said material from said drum.

20. A process comprising providing a drum comprising a hollow cylindrical metal substrate coated with at least one electrophotographic imaging layer, said substrate having an outer surface describing a curvilinear plane, removing said imaging layer, and removing metal from said substrate by precision lathing or by superfinishing grinding to a radial distance between about 10 micrometers and about 40 micrometers from said curvilinear plane to form a reclaimed substrate having a total indicated run out variation mean of less than about 160 micrometers and which is free of distortions visible to the naked eye, forming a fresh electrophotographic imaging layer on said reclaimed substrate, forming a uniform electrostatic charge on said fresh electrophotographic imaging layer, exposing said fresh electrophotographic imaging layer with digitized laser or light emitting diode activating radiation in image configuration to form an electrostatic latent image on said fresh electrophotographic imaging layer, developing said electrostatic latent image with toner particles to form a toner image, and transferring said toner image to a receiving member.

21. A process according to claim 20 comprising removing, after repeatedly forming and transferring toner images, said fresh coating and removing between about 10 micrometers and about 40 micrometers of metal from said substrate from the average curvilinear plane of said outer imaging surface, and forming at least one fresh electrophotographic imaging layer having a thickness between about 15 micrometers and about 60 micrometers on said substrate.

22. A process according to claim 20 comprising repeating said removing and coating steps after additional repeated forming and transferring of toner images until a radial depth of about 400 micrometers from the average curvilinear plane of said outer imaging surface has been reachd and said substrate is less than about 3 percent of the original diameter of said substrate.

* * * * *